US012305625B2

(12) United States Patent
Engels et al.

(10) Patent No.: US 12,305,625 B2
(45) Date of Patent: May 20, 2025

(54) LIQUID DISPENSER

(71) Applicant: Fast & Fluid Managment B.V., Sassenheim (NL)

(72) Inventors: Marcel Hendrikus Petrus Engels, Voorhout (NL); Mark Baak, Lisse (NL)

(73) Assignee: Fast & Fluid Management B.V., Sassenheim (NL)

( * ) Notice: Subject to any disclaimer, the term of this patent is extended or adjusted under 35 U.S.C. 154(b) by 0 days.

(21) Appl. No.: 18/843,613

(22) PCT Filed: Mar. 8, 2023

(86) PCT No.: PCT/EP2023/055841
§ 371 (c)(1),
(2) Date: Sep. 3, 2024

(87) PCT Pub. No.: WO2023/170117
PCT Pub. Date: Sep. 14, 2023

(65) Prior Publication Data

US 2025/0109740 A1 Apr. 3, 2025

(30) Foreign Application Priority Data

Mar. 9, 2022 (EP) ..... 22160980

(51) Int. Cl.
*F04B 13/00* (2006.01)
*F04B 7/00* (2006.01)
*F04B 53/10* (2006.01)

(52) U.S. Cl.
CPC ..... *F04B 13/00* (2013.01); *F04B 7/0023* (2013.01); *F04B 53/1092* (2013.01)

(58) Field of Classification Search
CPC .. B01F 33/8442; B01F 27/191; B01F 33/841; B01F 27/1123; F04B 13/00; F04B 7/0023; F04B 53/1092
See application file for complete search history.

(56) References Cited

U.S. PATENT DOCUMENTS 9,073,026 B2 * 7/2015 Engels ..... B01F 33/8442
9,289,734 B2 * 3/2016 Solera ..... B05B 15/52
(Continued)

FOREIGN PATENT DOCUMENTS

| | | | |
|---|---|---|---|
| CN | 110454350 | A | 11/2019 |
| EP | 3249222 | A1 | 11/2017 |
| JP | S5674715 | A | 6/1981 |

OTHER PUBLICATIONS

The International Search Report and The Written Opinion of The International Searching Authority, or The Declaration of corresponding PCT Application No. PCT/EP2023/055841, date of mailing Jul. 1, 2023, 11 pages.

*Primary Examiner* — Vishal Pancholi
(74) *Attorney, Agent, or Firm* — Tucker Ellis LLP; Michael G. Craig

(57) ABSTRACT

Dispenser for dispensing a liquid, in particular a colorant for paint. The dispenser comprises a piston pump and a valve. The piston pump comprises a cylinder and a main piston reciprocatingly fitted inside the cylinder. The valve comprises a valve housing with a dispense opening (16), and a valve core within the valve housing. The valve core is rotatable and comprises a main channel and a secondary dispense channel with a smallest diameter which smaller than the smallest diameter of the main channel. The secondary dispense channel comprises an axial channel section communicating with the piston pump. A secondary piston fits reciprocatingly inside the axial channel section in the valve core.

18 Claims, 8 Drawing Sheets

(56) References Cited

U.S. PATENT DOCUMENTS

2009/0236367 A1 9/2009 Voskuil et al.
2017/0349426 A1* 12/2017 Huang ..... F04B 49/22

* cited by examiner

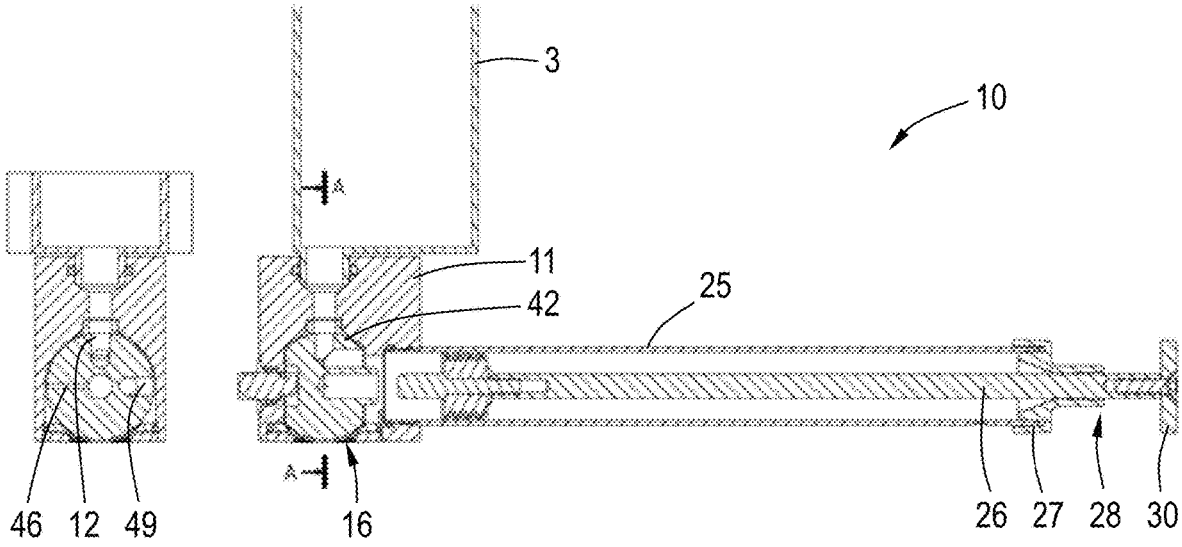
Fig. 3B
Fig. 3A
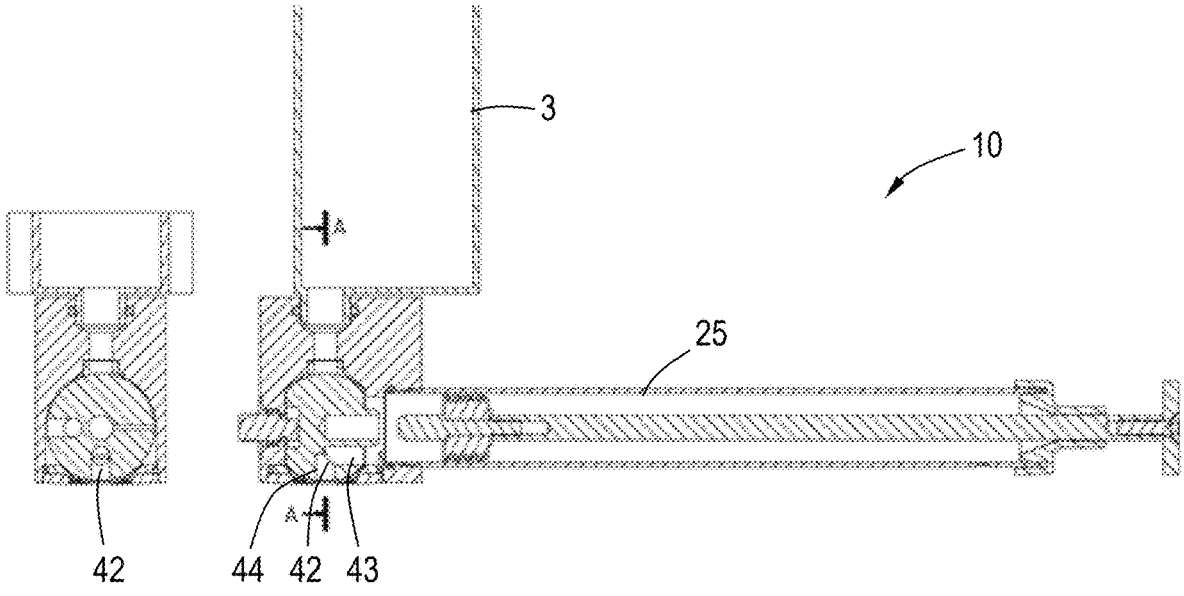
Fig. 4B
Fig. 4A

LIQUID DISPENSER

CROSS-REFERENCE TO RELATED APPLICATIONS

This application is a national phase application of International Application No. PCT/EP2023/055841, filed Mar. 8, 2023, which claims priority to European Patent Application Serial No. 22160980.3, filed Mar. 9, 2022, all of which are incorporated herein by reference.

BACKGROUND

The invention relates to a liquid dispenser, in particular for colorants or tinting pastes for paint. Such dispensers typically comprise a piston pump and a valve allowing the pump to withdraw an amount of colorant from a container, and to dispense it, e.g., into a receptacle such as a paint can.

Colorants must be dosed and metered very accurately in order to produce a paint matching a desired colour. To this end, some dispensers have pumps capable of dispensing larger volumes as well as smaller volumes.

An example of such a dispenser is disclosed in US 2009/0236367. This system uses a small sized piston nested in a larger piston pump. The construction is relatively complex and expensive to make. Biasing springs cause unwanted side effects.

EP3249222A1 discloses a colorant dispenser with a pump and a cylindrical valve core with a plurality of channels. The channels cause a high flow resistance and make it difficult for trapped air to escape from the liquid. The volume between the piston and the dosing outlet is large, so dosing accuracy is low. The dosing process requires a large number of steps to be taken.

SUMMARY

It is an object of the present invention to provide a dispenser of a simple and robust design suitable for dispensing larger amounts at high speed and smaller amounts with high accuracy.

The object of the invention is achieved with a dispenser for dispensing a liquid, in particular a colorant for paint, comprising a piston pump and a valve. The piston pump comprises a cylinder and a main piston reciprocatingly fitted inside the cylinder. The valve comprises a valve housing and a valve core within the valve housing, the valve core being rotatable about an axis of rotation (R). The valve core comprises a main channel, in particular for high speed dispensing of larger amounts, and a secondary dispense channel with a smallest diameter which smaller than the smallest diameter of the main channel, in particular for accurately dosing smaller amounts of liquid. The secondary dispense channel comprises an axial channel section communicating with the piston pump. A secondary reciprocating member fits reciprocatingly inside a pump space comprising the axial channel section in the valve core.

Preferably, the secondary reciprocating member fits reciprocatingly inside the axial channel section itself. However, in some cases the pump space may further comprise an intermediate tubular section with one end connecting to the axial channel section, e.g., a bent section facilitating an upright position of the pump, the secondary reciprocating member fitting reciprocatingly in a free second end of the intermediate tubular section.

The valve core can for example be a ball, a truncated ball, cylinder or (truncated) cone. The valve core is leak tight disposed within the valve housing and rotatable about the axis of rotation into a number of positions, such as:

- a suction position aligning the main channel with the canister to enable withdrawal of liquid from the canister by means of the piston pump;
- a fast dispense position aligning the main channel with a dispense opening of the valve housing;
- an accurate dispense position aligning the secondary dispense channel with the dispense opening, and optionally
- a closing position closing off the main channel as well as the secondary dispense channel.

The secondary dispense channel can have a further channel section e.g. a radial channel section, extending between the axial channel section and an outlet at the outer surface of the valve core. The radial channel section can for example define the smallest diameter of the secondary dispense channel.

The main channel has a relatively large diameter for fast dispensing and/or for dispensing relatively large amounts of the liquid and/or for returning colorant from the pump to the canister.

The valve also comprises a canister connection opening, preferably in the housing of the valve, for connecting a canister to the dispenser.

The secondary reciprocating member can for example be arranged to move with the main piston during at least a part of a pump stroke, so as to be operated by the main piston. To this end, the secondary reciprocating member can be mounted on, or form an integral part of the main piston of the piston pump, preferably on the end of the main piston facing the valve.

Alternatively, the secondary reciprocating member can be separate from the main piston and be biased towards the main piston, e.g. by means of a resilient element, such as a spring. In that case, the secondary reciprocating member can have one end with a flange or broadened head section slidingly locked within the axial channel section, and an opposite end arranged to be moved into the axial channel section by the main piston. To lock the flange or head section of the secondary reciprocating member, the axial channel can be provided with one or more stops, e.g. shoulders or a protruding rim.

The secondary reciprocating member can be a closed or solid piston. Alternatively, the secondary reciprocating member may be a hollow member, e.g., comprising a channel in the direction of the reciprocal movement along the full length of the secondary reciprocating member, e.g., the secondary reciprocating member being a hollow cylinder or sleeve.

In a specific embodiment, the axial channel section, the secondary reciprocating member and the main piston are coaxially aligned with the axis of rotation of the valve, e.g., with the secondary reciprocating member fitting reciprocatingly inside the axial channel section. In that case, the secondary reciprocating member can be moved within the axial channel section at different positions of the valve core. This is particularly useful, if the secondary reciprocating member is an extension of the piston head of the main piston.

Since the secondary reciprocating member communicates directly with the axial channel section in the valve core, the channels are short. This results in lower flow resistance and more accurate dosing since the piston and the secondary reciprocating member are close to the dispense opening. Hence, dispensing accuracy can be very high using very small minimum dispenses.

The dispenser of the present invention enables a relatively straightforward and/or robust construction and/or provides a high accuracy, preferably an accuracy of less than about 0.0015 ml, which is particularly significant in sample tinting. Also, as the axial channel in the valve core and the further reciprocating member are inherently close to the dispense opening, flow resistance and the effects of compressibility of the liquid on dispensing accuracy are reduced.

Optionally, the valve core comprises a return channel establishing fluid communication between the pump and the canister during a dispensing cycle via the secondary dispense channel. In the accurate dispense position of the valve core, the outlet of the secondary dispense channel is aligned with the dispense opening of the valve and the outlet of the return channel is aligned with the canister connection opening of the valve housing. While only small amounts can be dispensed via the secondary dispense channel, excess liquid can be returned to the canister via the return channel.

In a more specific embodiment, the return channel extends at least in part parallel or at an inclination to the axial channel section of the secondary dispense channel.

The volume of the secondary dispense channel can for example be such that a single stroke of the further piston is sufficient to dispense the required amount, which for small tints typically is in a range from 0.007 to 3 ml. To this end, the secondary dispense channel can have a stroke volume, e.g., in a range from 0.1 to 3 ml. The radial channel section of the secondary dispense channel can for example have a length in a range from 1 to 10 mm and/or a diameter in a range from 0.2 to 2 mm.

The lead edge of the further piston can for example be chamfered.

In a specific embodiment, the piston pump may for example be arranged in an upward position. For example, the pump space may further comprises a tubular section connecting to the axial channel section in the valve core, the tubular section comprising an upward section slidingly receiving the reciprocating member, which may for example be a piston or a hollow cylinder.

The dispenser of the present invention can for example be used in an apparatus for dispensing a plurality of liquids, in particular colorants for paint, comprising a linear table or a turntable rotatable around a vertical axis of rotation and a plurality of dispensers as described above, attached to and distributed along the edge of the table. The piston pumps can extend horizontally and, in case of a turntable, radially relative to the vertical axis of rotation.

BRIEF DESCRIPTION OF THE DRAWINGS

The invention is further explained with reference to the accompanying drawings showing exemplary embodiments.

FIG. 3A: shows a dispenser of the apparatus of FIG. 1 in cross section in a suction position;

FIG. 3B: shows the dispenser of FIG. 3A in cross section along line A-A;

FIG. 4A: shows a dispenser of the apparatus of FIG. 1 in cross section in a fast dispense position;

FIG. 4B: shows the dispenser of FIG. 3A in cross section along line A-A;

DETAILED DESCRIPTION

Figure 1:
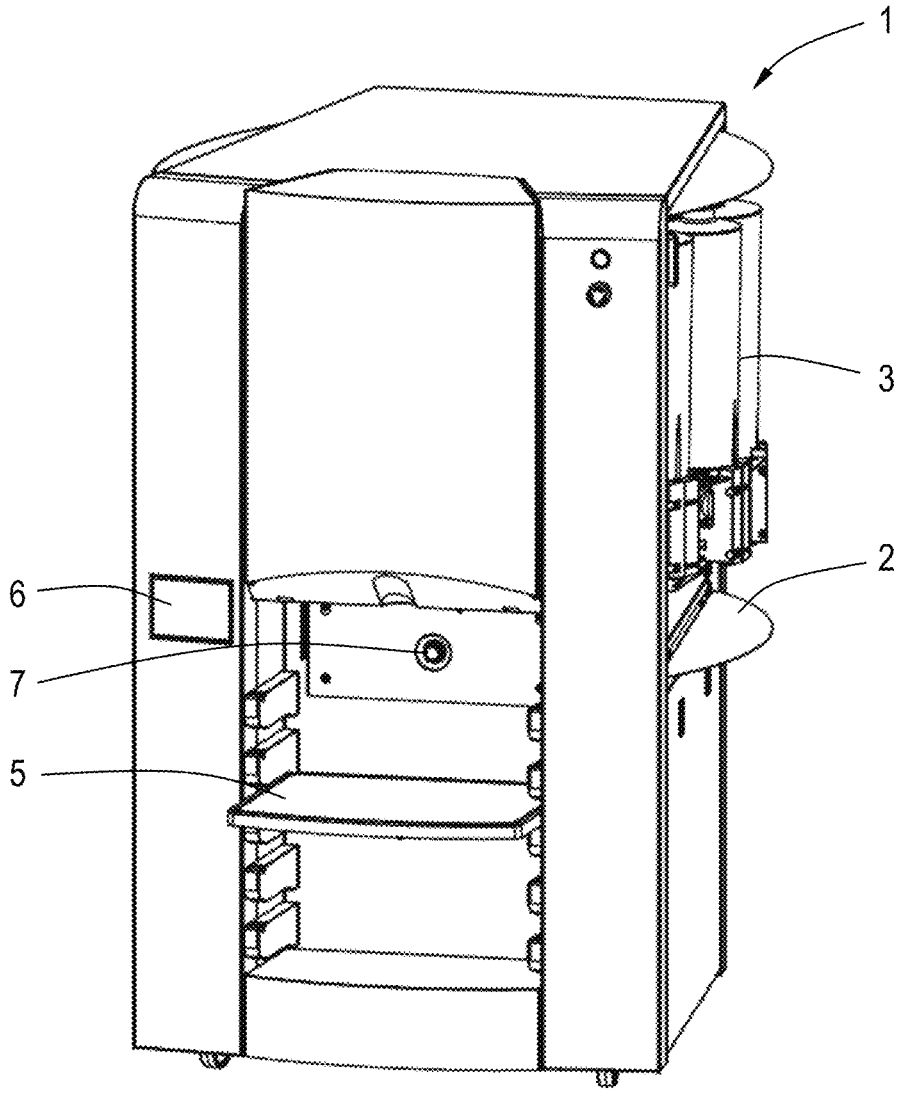
FIG. 1: shows an apparatus for mixing and dispensing paint products comprising a number of dispensers.

FIG. 1 shows an exemplary embodiment of a paint mixing and dispensing apparatus 1. The apparatus 1 comprises a turntable 2 carrying a circular array of canisters 3. Each canister 3 can be filled with a colorant or tinting paste of a given colour. The apparatus 1 comprises a platform 5 for supporting a paint can. When a paint can is placed on the platform 5 the turntable 2 can be rotated to position one of the canisters 3 holding a tinting paste of a selected colour above the paint can. The apparatus 1 may for example be provided with a user interface 6 allowing input of a desired paint colour by a user. A controller with a data processing unit (not shown) determines a paint formulation with the required amounts of the required tinting pastes providing the desired colour. Each canister 3 holding one of the tinting pastes used in the formulation is subsequently positioned above the paint can on the platform 5 and the required amount of the tinting paste is dispensed into the paint can in accordance with the formulation. These steps are repeated for all of the required colorants of the determined paint formulation. The apparatus 1 typically comprises a sensor 7 to detect whether or not a paint can is present on the platform 5.

Each canister 3 has a bottom with a tubular passage 8 connected to a dispenser 10, e.g., as shown in FIGS. 2A-5. The dispenser 10 comprises a valve 11 and a piston pump 12 operatively connected to the valve 11.

The valve 11 comprises a valve housing 13 with an interior space holding a valve core 14 with a narrow fit allowing rotation of the valve core 14 about an essentially horizontal axis of rotation R. The valve housing 13 comprises four openings opening into the interior space: a canister connection opening 15 at the top side of the valve housing 13 for connecting to the tubular passage 8 of the canister 3, a dispense opening 16 opposite to the canister connection opening 15, a driving axle opening 17 for a driving axle 18 rotating the valve core 14, and a pump opening 19 opposite to the driving axle opening 17, connecting to the piston pump 12. A first seal 16A engages the valve core around the dispense opening 16. A second seal 15A engages the valve core 14 around a passage opening of a canister channel 15B leading to the canister connection opening 15.

In the shown embodiment, the valve core 14 is essentially ball shaped, with truncated vertical side faces 20A, 20B perpendicular to the axis of rotation R. A first one of the truncated surfaces 20A is connected to the driving axle 18 extending through the sealed axle opening 17 of the valve housing 13. In response to signals from the controller, the driving axle 18 drives the valve core 14 to rotate to a selected position.

The piston pump 12 comprises a cylinder 25 and a main piston 26 slidable within the cylinder 25 between a dispensing position and a suction position. The cylinder 25 has one end leak tight connected to the pump opening 19 of the valve housing 13, and an opposite end comprising a closure 27 with a central opening 28. The main piston 26 comprises a piston rod 29 with a first end provided with a piston head 30 facing the pump opening 19 of the valve housing 13, and an opposite second end extending through the central opening 28 in the closure 27 (see FIG. 3A). This second end is provided with grip 30 operatively connected to an actuator (not shown) moving the piston 12 between the dispensing position and the suction position in response to control signals from the controller. The piston head 30 seals against the inner wall of the cylinder 25 while forming a sliding fit, allowing reciprocating movement.

The pump 12 comprises a secondary piston 40 extending from the piston head 30 toward the valve core 14. The secondary piston 40 is coaxially aligned with the piston rod 29, which is in turn aligned with the axis of rotation R.

In the shown embodiment of FIGS. 2A-5, the pump 12 is horizontal, so entrapped air can escape more easily via the canister.

The valve core 14 has a main channel 42 for withdrawing liquid content from the canister 3 in the suction position of the valve core 14 (shown in FIGS. 4A and 4B), and for dispensing of pump cylinder content when the valve core 14 is in the fast dispensing position (shown in FIGS. 4A and 4B). The main channel 42 has an axial main channel section 43 and a radial main channel section 44. The axial main channel section 43 runs between the pump opening 16 in the valve housing 13 and the radial main channel section 44. The axial main channel section 43 is parallel to the rotational axis R and connects to the space of the pump opening 19 at positions not aligned with the secondary piston 40. The radial main channel section 44 runs in radial direction from the axial main channel section 43 to the spherical outer surface of the valve core 14.

Figure 2A:
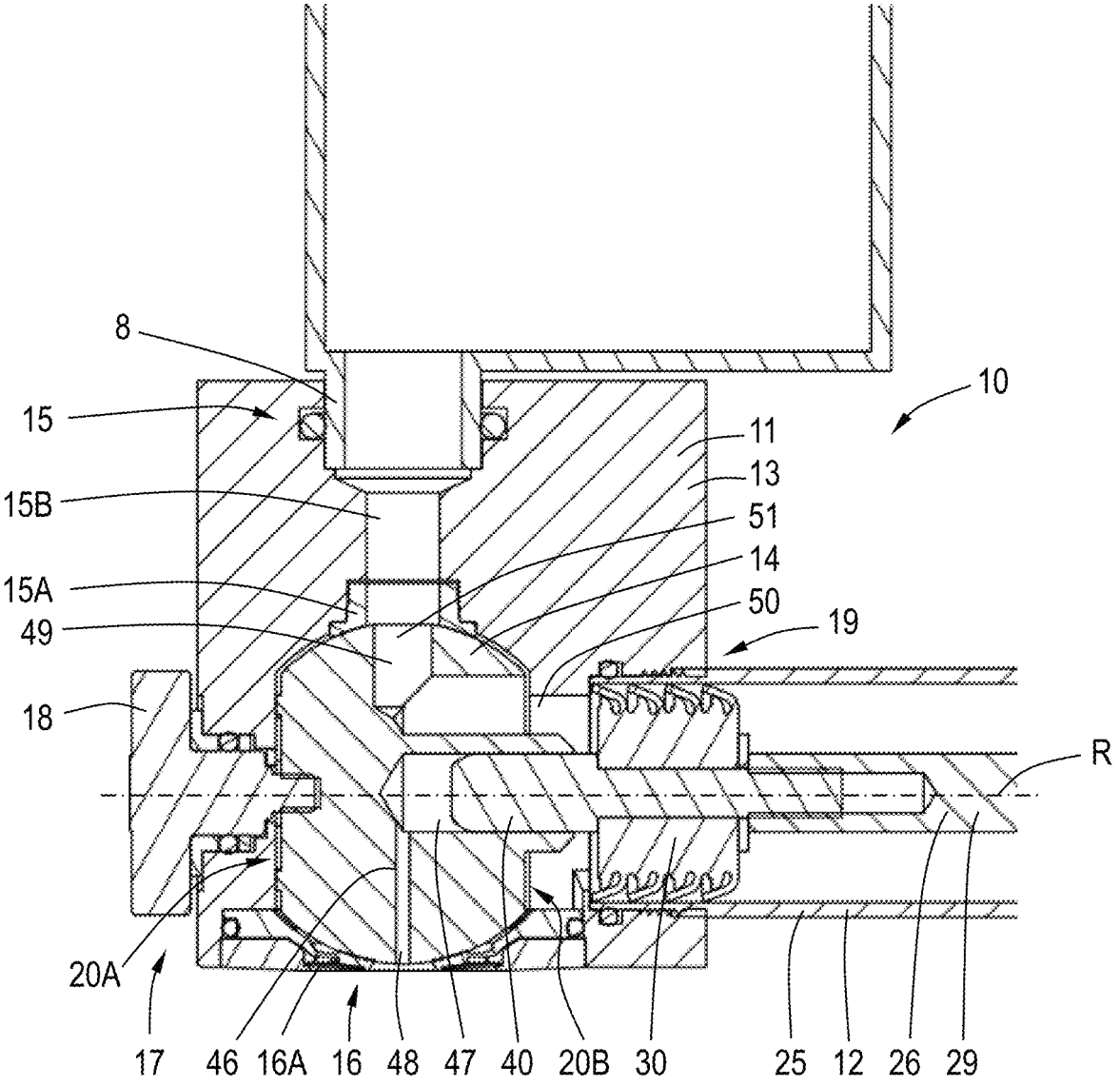
FIG. 2A: shows a dispenser of the apparatus of FIG. 1 in longitudinal cross section.
Figure 2B:
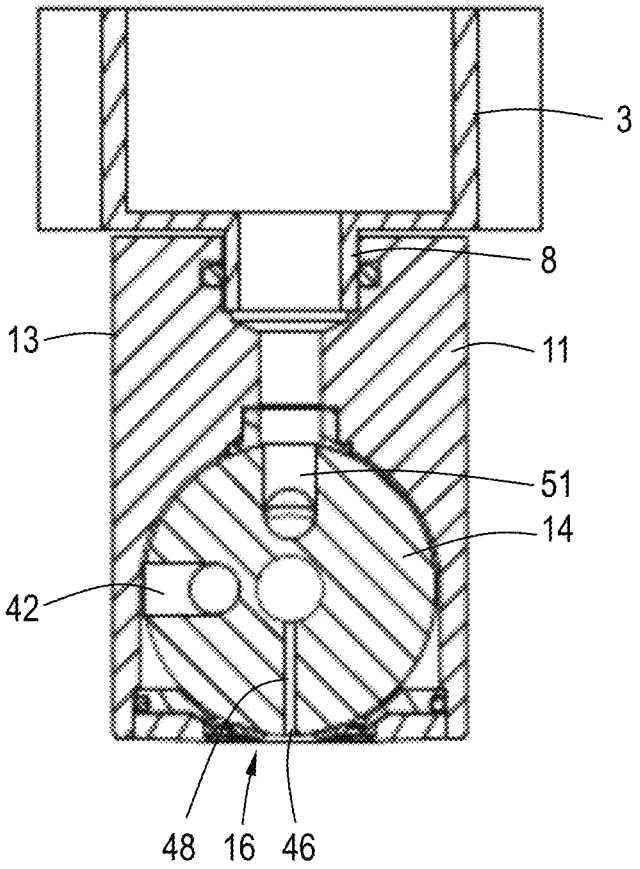
FIG. 2B: shows the dispenser of FIG. 2A in cross section along line A-A.

The valve core 14 further comprises a secondary dispense channel 46, better shown in FIGS. 2A and 2B. The secondary dispense channel 46 has an axial channel section 47 dimensioned and aligned to receive the secondary piston 40, and a radial channel section 48 with a diameter substantially smaller than the diameter of the main channel 42.

In addition to the two dispense channels 42, 46, the valve core 14 also comprises a return channel 49. The return channel 49 has essentially the same geometry as the main channel 42, with an axial return channel section 50 and a radial return channel section 51. The axial return channel section 50 runs between the pump opening 19 in the valve housing 13 and the radial return channel section 51. The axial return channel section 50 is parallel to the axis of rotation R and connects to the space of the pump opening 19 at positions not aligned with the secondary piston 40. The radial return channel section 51 runs in radial direction from outer end of the axial return channel section 50 to the spherical outer surface of the valve core 14. The radial return channel section 51 and the radial channel section 48 of the secondary dispense channel 46 extend radially at opposite sides of the axis of rotation R, as for example is shown in FIGS. 2A and 2B. Consequently, when valve core 14 is in the accurate dispensing position, the radial channel section 48 of the secondary dispense channel 46 is aligned with the dispense opening 16 of the valve housing 13 while the return channel 49 is aligned with the canister connection opening 15. Only small amounts can be dispensed via the secondary dispense channel 46. During dispensing via the secondary dispense channel 46, the return channel 49 serves to return excess colorant into the canister 3.

FIGS. 3A and 3B show the dispenser 10 during a suction stroke, when retracting the main piston 26 withdraws colorant from the canister 3 and gradually fills the cylinder 25 of the piston pump 12. During this step, the valve core 14 is rotated into a position closing off the dispense opening 16 of the valve housing 13. The secondary dispense channel 46 and the return channel 49 are closed off by the inner wall of the valve housing 13, while the main channel 42 fluidly connects the canister 3 with the interior space of the cylinder 25 of the piston pump 12. Moving the main piston 26 away from the valve 11 results in suction withdrawing colorant from the canister 3 via the main channel 42 into the cylinder 25 of the piston pump 12.

The dispenser 10 of the present invention can be used for fast dispensing larger amounts of colorant and for accurate dispensing smaller amounts. FIGS. 4A and 4B show the dispenser 10 in a position for fast dispensing. In this position, the main channel 42 connects the dispense opening 16 of the valve housing 13 and the pump opening 18 to enable a dispense flow from the cylinder 25 of the piston pump 12 via the main channel 42 to the dispense opening 16 while the main piston 26 is gradually moved towards the valve housing 13. The main piston 26 stops in response to the controller when a sufficient amount of colorant is dispensed. In this fast dispensing position, the secondary dispense channel 46 and the return channel 49 are closed off by the valve 11.

Figure 5:
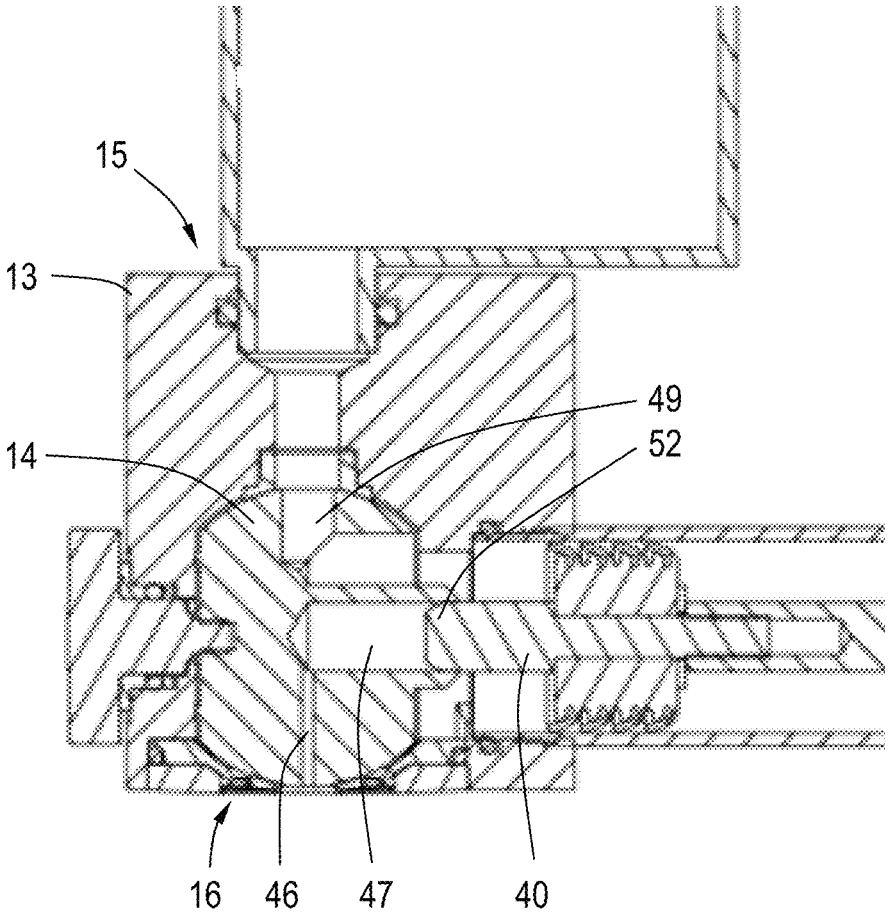
FIG. 5: shows a dispenser of the apparatus of FIG. 1 in cross section in an accurate dispense position.

To prepare for an accurate dispensing cycle via the secondary dispense channel 46, the valve core 14 is rotated into a position for accurate dispensing as shown in FIG. 5. In this position, the secondary dispense channel 46 is aligned with the dispense opening 16 of the valve housing 13, and the return channel 49 is aligned with the canister connection opening 15. The secondary piston 40 is then moved into a position where it just closes off the axial channel section 47 of the secondary dispense channel 46. The free outer end 52 of the secondary piston 40 is chamfered to facilitate easier positioning of the secondary piston 40 relative to the axial channel section 47. The secondary piston 40 is then moved deeper into the axial channel section 47 of the secondary dispense channel 46 so as to force colorant through the dispense opening 16 (see FIG. 2A). Liquid present in the space at the pump opening 19 outside the axial channel section 47 is moved to the canister 3 via the return channel 49. The small diameter of the radial section 48 of the secondary dispense channel 46 enables very accurate dosing and a significantly improved match between the resulting paint colour and the selected colour.

The secondary piston 40 is moved jointly with the main piston 26. To this end, the secondary piston 40 is fixed to the outer end of the main piston 26, as shown in the embodiment of FIGS. 2A-5, or forms an integral part of it.

Figure 6:
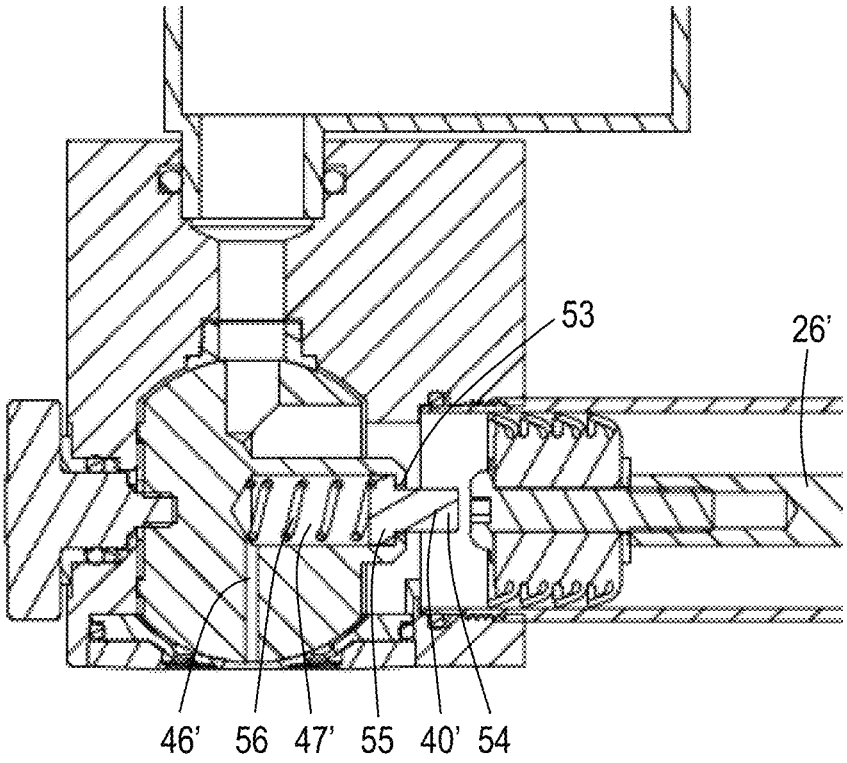
FIG. 6: shows a second exemplary embodiment of a dispenser in cross section.

FIG. 6 shows an alternative embodiment, having a secondary reciprocating member 40' which is aligned with the main piston 26', but forms a separate part. The axial channel section 47' of the secondary dispense channel 46' has an access opening restricted by an inwardly projecting circumferential rim 53. The secondary reciprocating member 40' has a main body 54 extending through the restricted access opening and one end with a broadened head or flange 55 locked within the axial channel section 47' by the circumferential rim 53. A spring element 56 biases the secondary piston 40' towards the main piston 26'. This simplifies the step of positioning the secondary piston just before the accurate dispensing step, as shown in FIG. 4A. During the accurate dispensing step, the main piston 26' pushes the secondary reciprocating member 40' into the axial channel section 47' to force colorant out via the dispense opening 16 of the valve housing 13.

Figure 7:
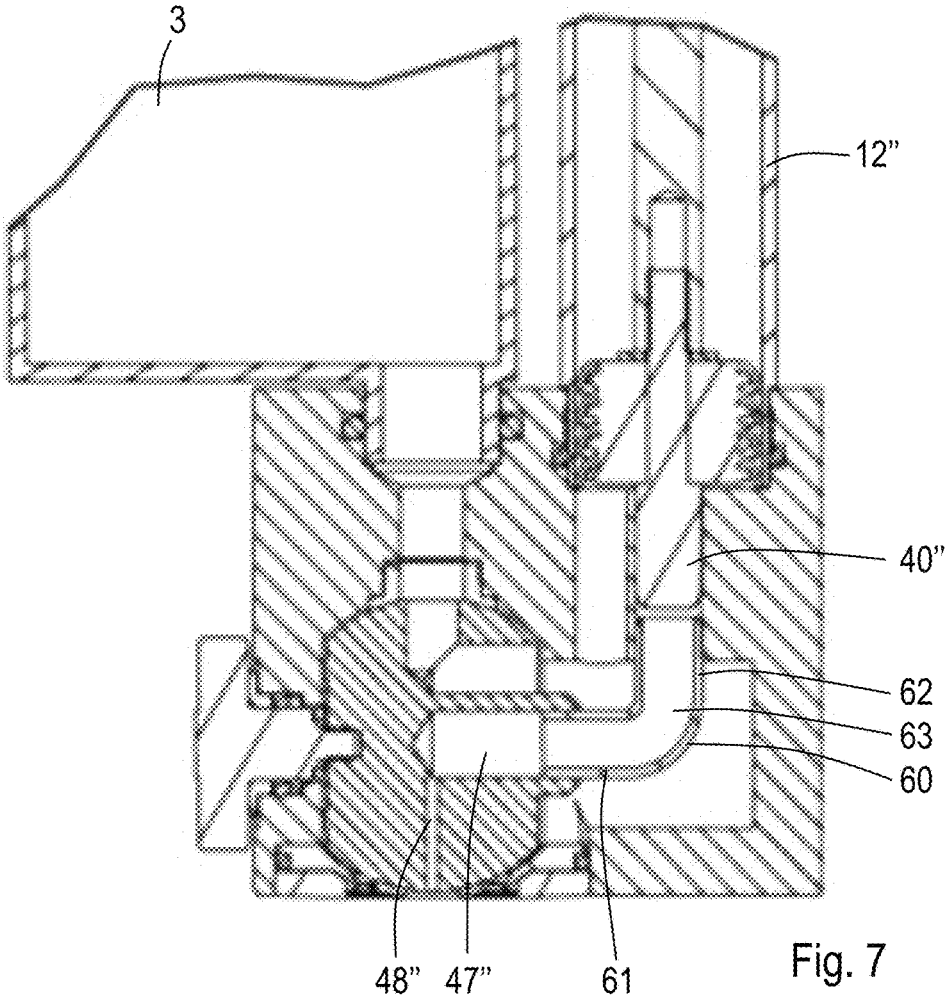
FIG. 7: shows a third exemplary embodiment of a dispenser in cross section.

FIG. 7 shows a further embodiment, which is similar to the embodiment of FIGS. 2A-5, except that the piston pump 12" is arranged in a vertical position, and the pump opening 18" is on the top side of the valve housing 13, next to the canister 3. A bent pipe section 60 comprises a horizontal part 61 connected to the axial channel section 47, and a vertical section 62 receiving the secondary piston 40". The axial channel section 47 and the bent pipe section 60 form a small pump space 63 where liquid is forced into the radial channel section 48" while the secondary piston 40" moves downward through the vertical section 62 of the bent pipe section 60.

Figure 8:
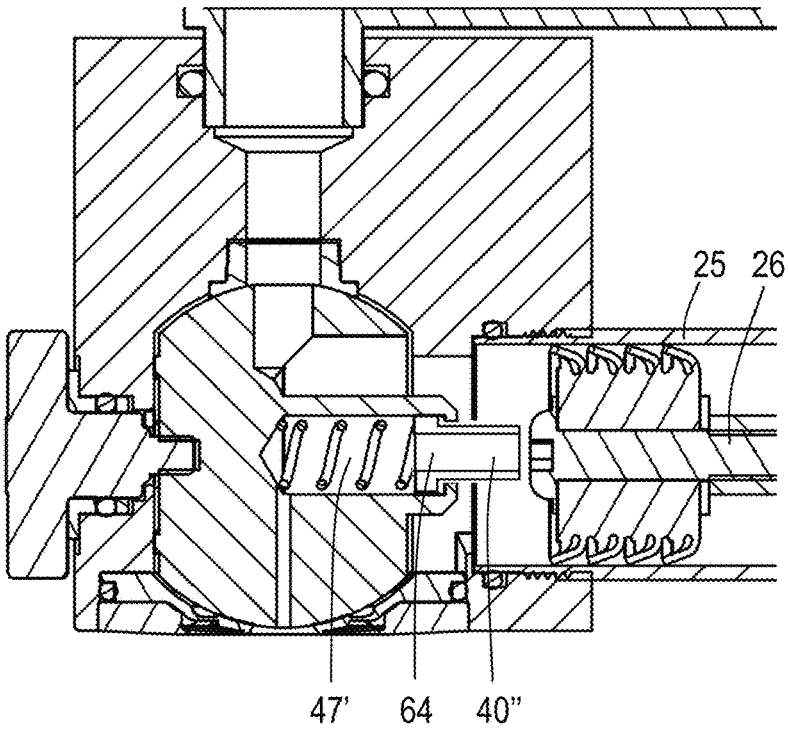
FIG. 8: shows a fourth exemplary embodiment of a dispenser in cross section.

FIG. 8 shows a further embodiment, which is similar to the embodiment of FIG. 6, with the difference that the secondary reciprocating member is not a closed piston but a hollow cylindrical part 40" with a central channel 64 extending in axial direction, coaxial with the axial channel section 47'. The central channel 64 connects the axial channel section 47' with the interior of the cylinder 25. Due to this connection, the axial channel section 47' is easier filled with liquid to be dispensed during a suction stroke.

FIGS. 9A-9D shows an embodiment, which is similar to the embodiment of FIG. 7, except that the secondary reciprocating member 40'" is not a closed piston but a separate hollow cylindrical part with a central longitudinal channel 64', like the secondary reciprocating member 26" of the embodiment of FIG. 8. The piston pump 12' is arranged in a vertical position, and the pump opening is on the top side of the valve housing 13', next to the canister 3. A bent pipe section 60' comprises a horizontal part 61' connected to the axial channel section 47", and a vertical section 62' receiving the secondary reciprocating member 40'". The axial channel section 47' and the bent pipe section 60' form a small pump space 63'. A pump channel 66 connects the interior of the pump cylinder 25 and the main channel 42 in the valve core 14. The pump channel 66 comprises a first pump channel section 67 enclosing the bent pipe section 60 and a second pump channel section 68 extending vertically and enclosing the vertical section 62' receiving the secondary reciprocating member 40".

Between the valve core 14 and the inner walls of the valve housing 13 is a gap 65 which is sealed at the dispense opening 16 by the first seal 16A and at the canister channel 15 by the second seal 15A. The gap 65 is in fluid communication with the first pump channel section 67.

Figure 9A:
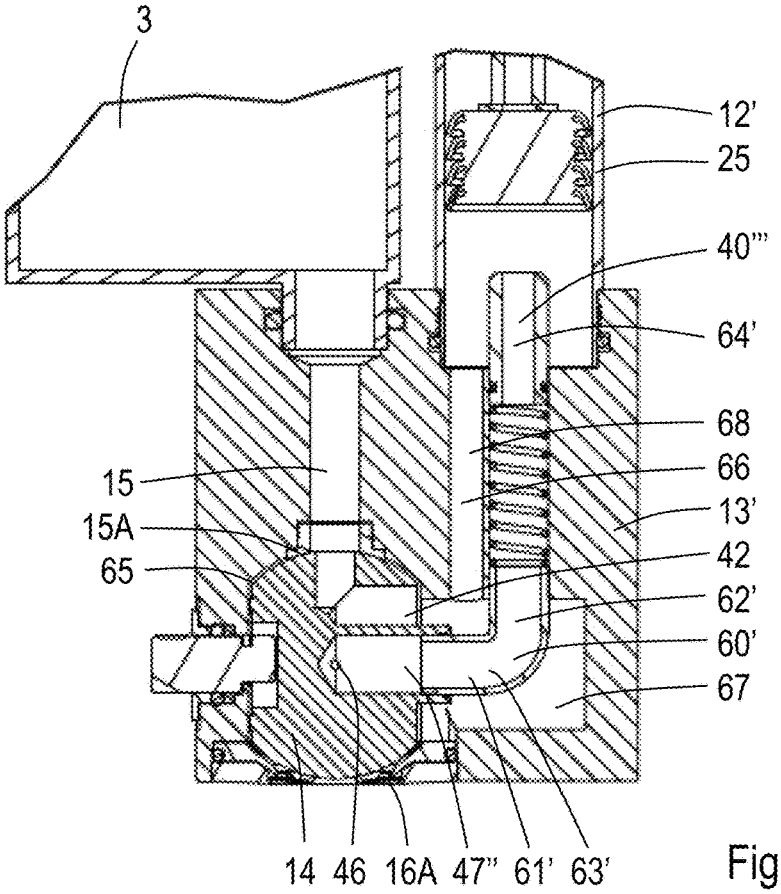
FIG. 9A: shows a fourth exemplary embodiment of a dispenser in cross section during a suction stroke.

In FIG. 9A, the main piston 25 is moved upward to withdraw liquid from the canister 3 via the main channel 42. Simultaneously, the upward movement of the piston 25 creates a suction in the small pump space 63' generating a secondary flow of liquid from the first pump channel section 67 into the gap 65 between the valve core and the inner walls of the valve housing and subsequently via the radial secondary dispense channel 46 into the axial channel section 47".

Figure 9B:
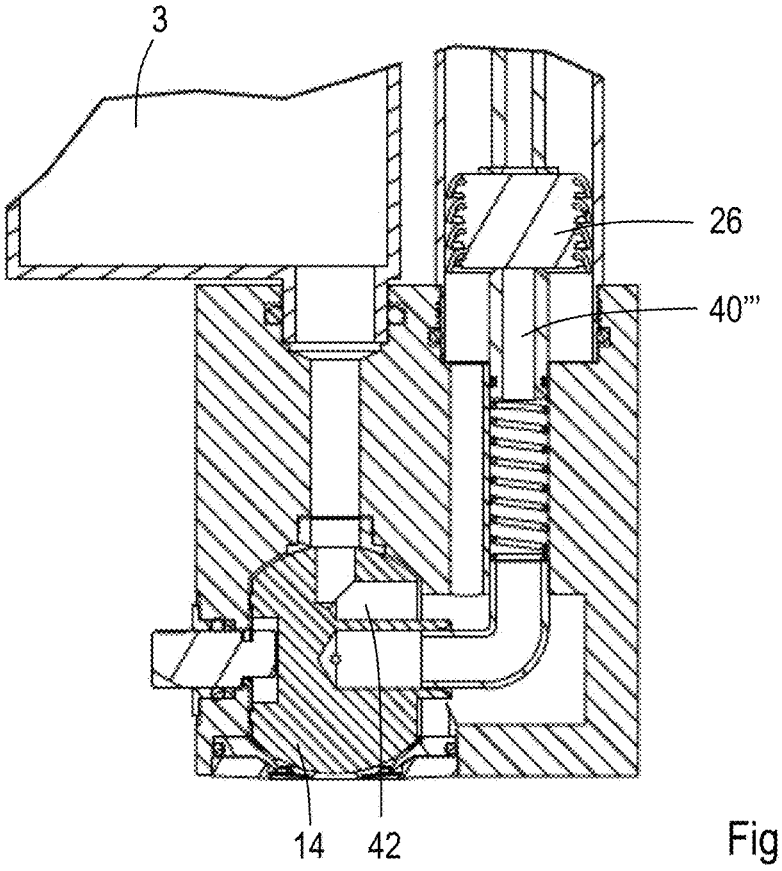
FIG. 9B: shows the embodiment of FIG. 9A at the start of a small amount dispensing step.

To dispense a small amount of liquid, the main piston 26 is first moved down to close off the secondary reciprocating member 40", while the valve core 14 is still in the same position (see FIG. 9B). Excess liquid flows back into the canister 3 via the main channel 42 and the canister channel 15.

Figure 9C:
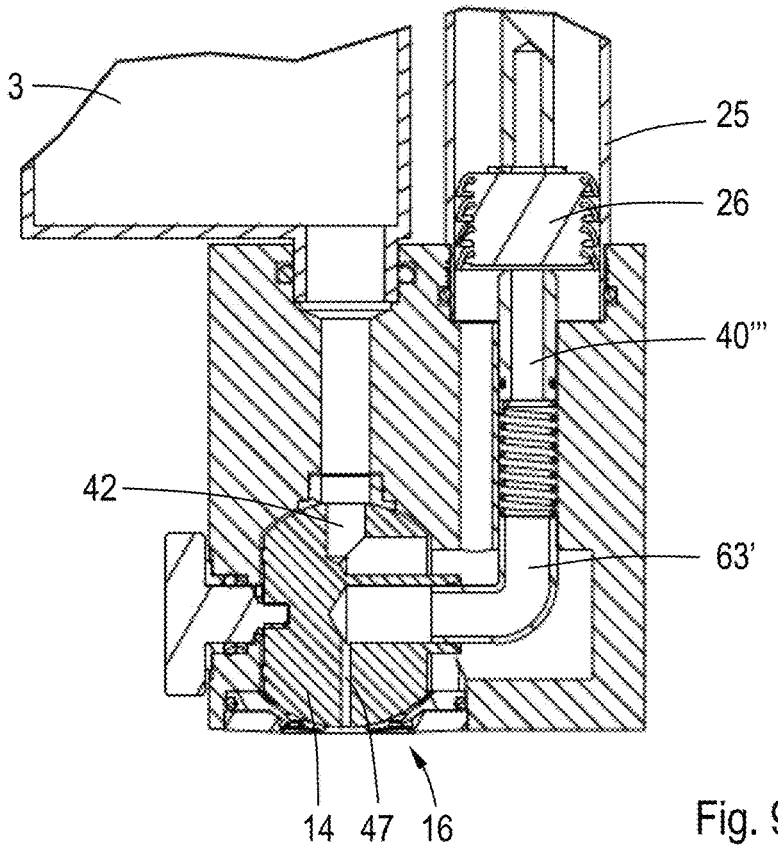
FIG. 9C: shows the embodiment of FIGS. 9A and 9B during a small amount dispensing step.

Subsequently, the valve core 14 is rotated until the radial secondary dispense channel 47 is aligned with the dispense opening 16 (see FIG. 9C). By moving the piston 26 further down, liquid is dispensed from the small pump space 63' via the axial secondary dispense channel 47. Liquid in the interior of the pump cylinder 25 outside the small pump space 63' is returned to the canister 3 via the main channel 42.

Figure 9D:
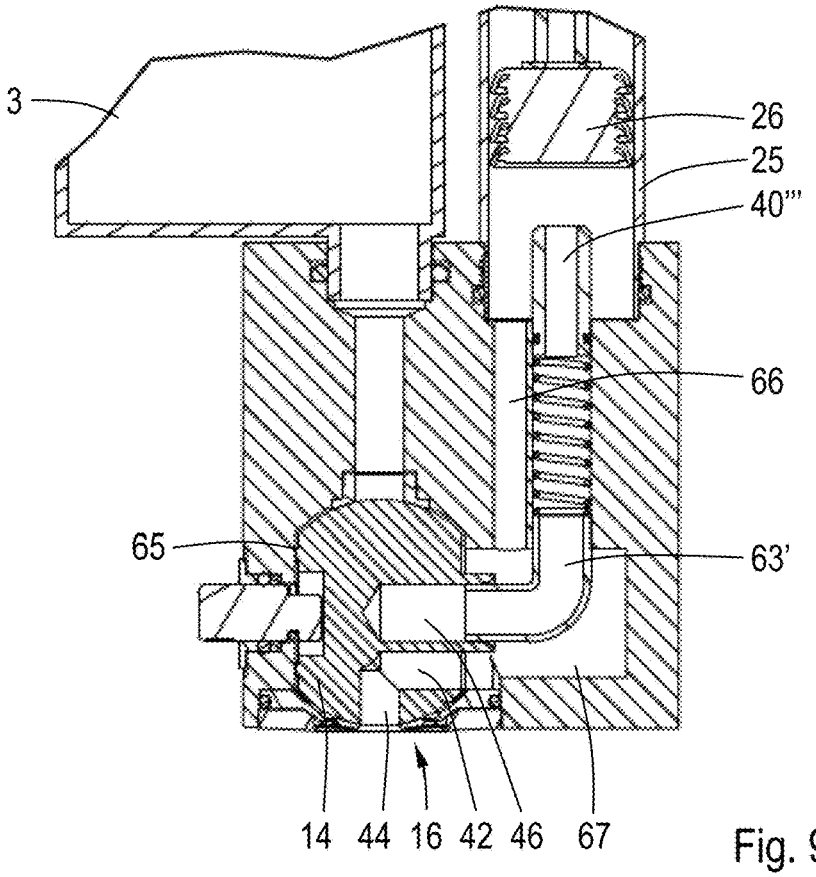
FIG. 9D: shows the embodiment of FIGS. 9A-C during a large amount dispensing step.

FIG. 9D shows how a larger amount of liquid is dispensed. The valve core 14 is rotated into a position aligning the radial main channel section 44 of the main channel 42 with the dispense opening 16. The piston 26 is then moved down. Liquid is moved from the interior of the pump cylinder 25 and the pump channel 66 via the radial main channel section 44 to the dispense opening 16. Part of the liquid in the small pump space 63' is moved via the secondary dispense channel 46 into the gap 65 and subsequently into the first pump channel section 67, where it joins the main flow via the main channel 42 to the dispense opening 16.

The invention claimed is:

1. A dispenser for dispensing a liquid comprising
- a piston pump comprising a cylinder and a main piston reciprocatingly fitted inside the cylinder; and
- a valve comprising a valve housing with a dispense opening, and a valve core within the valve housing, the valve core being rotatable about an axis of rotation and comprising:
  - a main channel;
  - a secondary dispense channel with a smallest diameter which is smaller than the smallest diameter of the main channel, wherein the secondary dispense channel comprises an axial channel section communicating with the piston pump, and the dispenser comprises a secondary reciprocating member that fits reciprocatingly inside a pump space comprising the axial channel section in the valve core.

2. The dispenser according to claim 1, wherein the secondary reciprocating member is arranged to move with the main piston during at least a part of a pump stroke.

3. The dispenser according to claim 2, wherein the secondary reciprocating member is a secondary piston mounted on, or forming an integral part of, the main piston.

4. The dispenser according to claim 1, wherein the secondary reciprocating member has one end with a flange or head section locked inside the axial channel section in the valve core, and an opposite end arranged to engage the main piston.

5. The dispenser according to claim 1, wherein the secondary reciprocating member is separate from the main piston and biased towards the main piston.

6. The dispenser according to claim 5, wherein the secondary reciprocating member comprises a channel in the direction of the reciprocal movement along the full length of the reciprocating member.

7. The dispenser according to claim 1, wherein the secondary dispense channel further comprises a radial channel section extending between the axial channel section and an outer surface of the valve core.

8. The dispenser according to claim 1, wherein the secondary reciprocating member is a secondary piston and the axial channel section, the secondary piston and the main piston are coaxially aligned with the axis of rotation of the valve.

9. The dispenser according to claim 1, wherein the valve core comprises a return channel, extending between the pump and a canister connection opening of the valve housing when the secondary dispense channel is aligned with a dispense opening of the valve housing.

10. The dispenser according to claim 1, wherein the axial channel section of the secondary dispense channel is coaxial with the axis of rotation of the valve core.

11. The dispenser according to claim 1, wherein the axial channel section of the secondary dispense channel has a volume in a range from 0.1 to 3 ml.

12. The dispenser according to claim 7, wherein the radial channel section of the secondary dispense channel has a length in a range from 1 to 10 mm and/or a diameter in a range from 0.2 to 2 mm.

13. The dispenser according to claim 1, wherein the secondary reciprocating member has a chamfered lead edge.

14. The dispenser according to claim 1, wherein the pump space further comprises a tubular section connecting to the axial channel section in the valve core, the tubular section comprising an upward section slidingly receiving the reciprocating member, the piston pump being arranged in an upward position.

15. An apparatus for dispensing a plurality of liquids, comprising a linear table or a turntable rotatable around a vertical axis of rotation and a plurality of dispensers according to claim 1, attached to and distributed along the edge of the table.

16. The dispenser according to claim 5, wherein the secondary reciprocating member is separate from the main piston and biased towards the main piston by a spring.

17. The dispenser according to claim 6, wherein the reciprocating member is a hollow cylinder or sleeve.

18. The dispenser according to claim 8, wherein the secondary piston fits reciprocatingly inside the axial channel section.

* * * * *